US006120396A

United States Patent [19]

Van Nimwegen et al.

[11] Patent Number: 6,120,396

[45] **Date of Patent: *Sep. 19, 2000**

[54] QUICK-RELEASE LOCKING MECHANISM FOR ADJUSTABLE BASKETBALL GOAL SYSTEM AND METHODS FOR USING SAME

[75] Inventors: Edward G. Van Nimwegen, North Ogden; David C. Winter, Layton, both of Utah

[73] Assignee: Lifetime Products, Inc., Clearfield, Utah

[ * ] Notice: This patent is subject to a terminal disclaimer.

[21] Appl. No.: 09/236,817

[22] Filed: Jan. 25, 1999

Related U.S. Application Data

[63] Continuation-in-part of application No. 09/018,231, Feb. 3, 1998, which is a continuation-in-part of application No. 08/986,382, Dec. 8, 1997, Pat. No. 5,879,247, which is a continuation of application No. 08/799,979, Feb. 12, 1997, Pat. No. 5,695,417

[60] Provisional application No. 60/077,855, Mar. 13, 1998.

[51] Int. Cl.[7] ..... A63B 63/08

[52] U.S. Cl. ..... 473/484; 473/483; 473/482; 473/481; 248/283.1; 248/280.11

[58] Field of Search ..... 473/471, 481, 473/482, 483, 484; 248/283.1, 404, 280.11

[56] References Cited

U.S. PATENT DOCUMENTS

| | | |
|---|---|---|
| D. 350,797 | 9/1994 | Curtis . |
| 1,924,811 | 8/1933 | Schulz . |
| 2,932,511 | 4/1960 | Bemis . |

(List continued on next page.)

FOREIGN PATENT DOCUMENTS

| | | | |
|---|---|---|---|
| 28616 | 2/1965 | Netherlands | 473/484 |

OTHER PUBLICATIONS

"Introducing New Huffy Elevator," Informational Brochure, Huffy Sports, Waukesha, Wisconsin (Date unknown).

"Adjustable Backstop Support, Backboard and Goal Kit," Informational Brochure, Wilson, Franklin Park, Illinois (Date unknown).

"All–in–One "Quick Adjust" Kits," Informational Brochure, Porter (Date unknown).

"Component Play Grounds", Equipment Brochure, Salt Lake city, Utah, p. 6 (Date unknown).

Diversified Products, "DP Fit for Life," 1990 Equipment Catalog, Opelika, Alabama, p. 61.

Huffy Sports, "Basketball's Hottest Products this Year," Equipment Catalog, Waukesha, Wisconsin (Date unknown).

Huffy Sports, Equipment Catalog, Waukesha, Wisconsin, p. 21 (Date unknown).

(List continued on next page.)

*Primary Examiner*—Raleigh W. Chiu
*Attorney, Agent, or Firm*—Madson & Metcalf

[57] ABSTRACT

The present invention relates to a quick-release locking mechanism for adjustable basketball goal system and methods for using the same which facilitates an adjustment in the height of a basketball goal above a playing surface. The adjustable basketball goal system includes a deformable goal support structure attached at one end to a rigid support. A basketball goal is preferably attached at the other end of the goal support structure. A locking rod is also attached to the rigid support. An extension arm is positioned between the goal support structure and a housing which movably engages the locking rod. The housing is configured with one or more locking plates kept at non-perpendicular angles to the locking rod by a biasing spring. In this configuration, the locking plates selectively bind the locking rod and prevent movement of the extension arm relative to the locking rod. An adjustment handle may be provided to engage the locking plates and move them into a substantially perpendicular angle relative to the locking rod, thus allowing for an adjustment in the height of the basketball goal above the playing surface.

27 Claims, 4 Drawing Sheets

U.S. PATENT DOCUMENTS

| | | |
|---|---|---|
| 3,427,025 | 2/1969 | Procter . |
| 3,586,324 | 6/1971 | Bearson . |
| 3,765,676 | 10/1973 | Bearson et al. . |
| 3,802,702 | 4/1974 | Pulley . |
| 4,395,040 | 7/1983 | White . |
| 4,438,923 | 3/1984 | Engle et al. . |
| 4,441,709 | 4/1984 | Schroeder et al. . |
| 4,684,129 | 8/1987 | Andersen et al. . |
| 4,781,375 | 11/1988 | Nye . |
| 4,798,381 | 1/1989 | Dadbeh . |
| 4,801,142 | 1/1989 | Friesen . |
| 4,805,904 | 2/1989 | Nye . |
| 4,846,469 | 7/1989 | Nye . |
| 4,881,734 | 11/1989 | Nye . |
| 5,133,547 | 7/1992 | Pardi . |
| 5,158,281 | 10/1992 | Williams . |
| 5,259,612 | 11/1993 | Matherne et al. . |
| 5,388,821 | 2/1995 | Blackburn . |
| 5,465,957 | 11/1995 | Schroeder . |
| 5,478,068 | 12/1995 | Schroeder . |
| 5,503,390 | 4/1996 | Hall . |
| 5,573,237 | 11/1996 | Van Nimwegen et al. . |
| 5,573,238 | 11/1996 | Aaron et al. . |
| 5,601,284 | 2/1997 | Blackwell et al. . |
| 5,695,417 | 12/1997 | Winter et al. . |
| 5,720,679 | 2/1998 | Schroeder . |
| 5,738,601 | 4/1998 | Hughes . |
| 5,879,247 | 3/1999 | Winter et al. . |

OTHER PUBLICATIONS

Diversified Products, "25 Years of Innovation," Opelika, Alabama, p. 69 (Date unknown).

Huffy Sports, "Our All–Star Lineup," Waukesha, Wisconsin, p. 21 (Date unknown).

Harvard, "1988 Sporting Goods Catalog, " p. 8.

Huffy Sports, Equipment Assembly Instruction Sheet, Waukesha, Wisconsin (Date unknown).

QUICK-RELEASE LOCKING MECHANISM FOR ADJUSTABLE BASKETBALL GOAL SYSTEM AND METHODS FOR USING SAME

RELATED U.S. APPLICATIONS

This application claims the benefit of U.S. Provisional Application No. 60/077,855 filed Mar. 13, 1998 and entitled ADJUSTABLE BASKETBALL GOAL SYSTEM, and is a continuation-in-part of our patent application Ser. No. 09/018,231, filed Feb. 3, 1998 and entitled ADJUSTABLE BASKETBALL GOAL SYSTEM, which is a continuation-in-part of application Ser. No. 08/986,382 filed Dec. 8, 1997 and entitled POWER LIFT BASKETBALL ADJUSTMENT SYSTEM now U.S. Pat. No. 5,879,247, which is a continuation of application Ser. No. 08/799,979 filed Feb. 12, 1997 and entitled POWER LIFT BASKETBALL ADJUSTMENT SYSTEM now issued as U.S. Pat. No. 5,695,417. The foregoing applications are hereby incorporated herein by reference.

BACKGROUND

1. The Field of the Invention

The present invention is related to an apparatus and method for adjusting the height of a basketball goal. More particularly, the present invention is related to novel basketball adjustment systems having an extension arm adjustable between a plurality of positions by a quick-release locking plate mechanism to facilitate the adjustment of the basketball goal over a playing surface.

2. Technical Background

Basketball is an increasingly popular sport in the United States and abroad. There are many cities, counties, and other associations that sponsor recreational and instruction leagues where people of all ages can participate in the sport of basketball. Today there are organized leagues for children as young as five and six years old. Accordingly, is not surprising that more and more people have a basketball goal mounted on their property.

The problem with many basketball goals is that the goal is usually fixed at a certain height above the playing surface with a standard height being about ten (10) feet. Children and younger teens, however, generally don't have the strength or agility to make a basket at a height of ten feet. Moreover, children tend to develop improper shooting skills attempting to throw a basketball toward a goal that is too high. Oftentimes, children or younger teens get frustrated with the sport of basketball and may give up the sport altogether.

Many attempts have been made by those skilled in the art to design basketball goal systems which are adjustable to several different heights. This allows persons of all ages and sizes to enjoy the sport of basketball because the basketball goal can be adjusted to various heights above the playing surface. Some of the prior art basketball goal systems employ a deformable linkage design which generally connects the backboard to a rigid mount such as a pole. In operation, prior art deformable linkages can be selectively locked at various positions to secure the basketball goal at a predetermined height above a playing surface.

One disadvantage of prior art deformable linkage devices is that the adjustment mechanism is typically positioned within or near the linkage well above the playing surface. Accordingly, whenever a user desires to adjust the height of the basketball goal, the use of a ladder, stool, or the like is required to enable the user to reach the adjustment mechanism and "unlock" the basketball goal. Having to use a ladder, stool, or the like to adjust the height of the basketball goal creates an inherent danger to the user of the potential for falling.

Other prior art adjustable basketball goal systems have adjustment mechanisms that are only accessible with the use of a separate rod or pole, such as a broomstick handle. Often times, there is not such an adjustment device readily available. The user must therefore accommodate the inconvenience of having to find a suitable implement, or simply choose not to adjust the height of the basketball goal.

Adjustable basketball goals were also developed in such a manner that the entire weight of the basketball goal bears directly on the adjustment system. One disadvantage of these prior art configurations is that it takes more strength and patience to adjust the height of the basketball goal than typical children or younger teens possess. This is unfortunate because it is usually small children or younger teens who have the greatest need to adjust the height of the basketball goal.

Another disadvantage of many prior art adjustable basketball goal systems is that the adjustment mechanism is generally separate and distinct from the securing apparatus. In this regard, both hands of a user are normally needed to simultaneously unlock the system, adjust it and then lock it again in a predetermined position.

Yet another disadvantage of prior art basketball goal adjustment systems is that many of the securing and adjustment mechanisms require numerous working components and a complex design configuration to be able to simultaneously adjust and secure the basketball goal system in a predetermined position above a playing surface. This increases the cost and difficulty of manufacture and the time for assembly by a user.

From the foregoing, it will be appreciated that it would be an advancement in the art to provide an adjustable basketball goal system that can be adjusted without the use of a ladder or a pole. It would be a further advancement to provide such an adjustable basketball goal system that could be adjusted quickly and easily with the use of a single hand of a user. Finally, it would be another advancement in the art to provide such an adjustable basketball goal system that is simple in design and cost effective relative to manufacture.

Such an adjustable basketball goal system is disclosed and claimed herein.

BRIEF SUMMARY OF THE INVENTION

The present invention is directed to a novel quick-release locking mechanism for adjustable basketball goal system which facilitates adjusting the height of a basketball goal above a playing surface. The basketball goal system of the present invention includes a rigid support which extends in a substantially upward direction. The rigid support has a goal side and a back side opposite the goal side. A deformable goal support structure may be pivotally attached to the goal side of the rigid support such that the goal support structure is suspended above the playing surface. A basketball goal is preferably attached to the goal support structure adjacent the goal side of the rigid support. In one presently preferred embodiment, the goal consists of a rim and backboard. The goal support structure is preferably configured such that as the goal support structure deforms, the height of the basketball goal above the playing surface is correspondingly adjusted, wherein each variation in height of the basketball goal corresponds to a different deformation of the goal support structure. In operation, the preferred configuration of the goal support structure allows the rim of the basketball goal to be adjusted at several different heights while retaining the rim in a substantially horizontal disposition.

An extension arm is preferably attached at a first end to the goal support structure and generally extend down along the back side of the rigid support. In one presently preferred embodiment, a locking rod is movably attached at a first end to the back side of the rigid support. A second end of the locking rod is disposed for cooperation with the extension arm. The second end of the locking rod preferably engages a second end of the extension arm in a telescoping manner.

At least one and preferably multiple locking plates are positioned within an opening formed in the extension arm. The locking plates include openings through which the locking rod is positioned. These openings are preferably configured to permit the locking plates to be positioned in a non-perpendicular angle relative to the locking rod.

In one presently preferred embodiment, a biasing member is operably disposed between the locking plates such that the locking plates are biased away from each other into a non-perpendicular position relative to the locking rod. In this configuration, the plates within the extension arm bind the locking rod and prevent the extension arm from moving, thus securing the basketball goal at a particular height. This design efficiently utilizes the forces acting on the adjustable basketball goal system to lock the system in place without the need of a complex operational design or numerous intricate working components.

An adjustment handle is movably mounted to an outside surface of the extension arm and is configured to engage one end of each of the respective locking plates. The adjustment handle is generally movable between a rest position wherein the locking plates bind with the locking rod and an engaged position wherein a portion of the adjustment handle forces a set of locking plates into a substantially perpendicular position relative to the locking rod. The adjustment handle can be moved upward or downward along the length of the extension arm, thus releasing the locking plates which bind the extension arm to the locking rod. Upon release, movement of the adjustment handle moves the extension arm relative to the locking rod, deforming the goal support structure and thereby adjusting the height of the basketball goal above the playing surface.

In one presently preferred embodiment of the present invention, the adjustable basketball goal system is counterbalanced with a counterbalance member attached to the goal support structure. In operation, the counterbalance member provides a resistance force that substantially counterbalances the gravitational force acting against the adjustable basketball goal system due to the weight of the basketball goal.

Thus, it is an advantage of the present invention to provide a quick-release locking mechanism for adjustable basketball goal system that is cost effective to manufacture and easy to assemble. It is another advantage of the present invention to be able to adjust the height of the basketball goal without the aid of a ladder or pole. It is a further advantage of the present invention to be able to "unlock" the system and simultaneously adjust the height of the basketball goal using only one hand of a user. Moreover, it is an advantage of the present invention in that adjusting the height of the basketball goal only requires a minimal force applied by the user.

These and other advantages of the present invention will become more fully apparent by examination of the following description of the preferred embodiments and the accompanying drawings.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 4, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
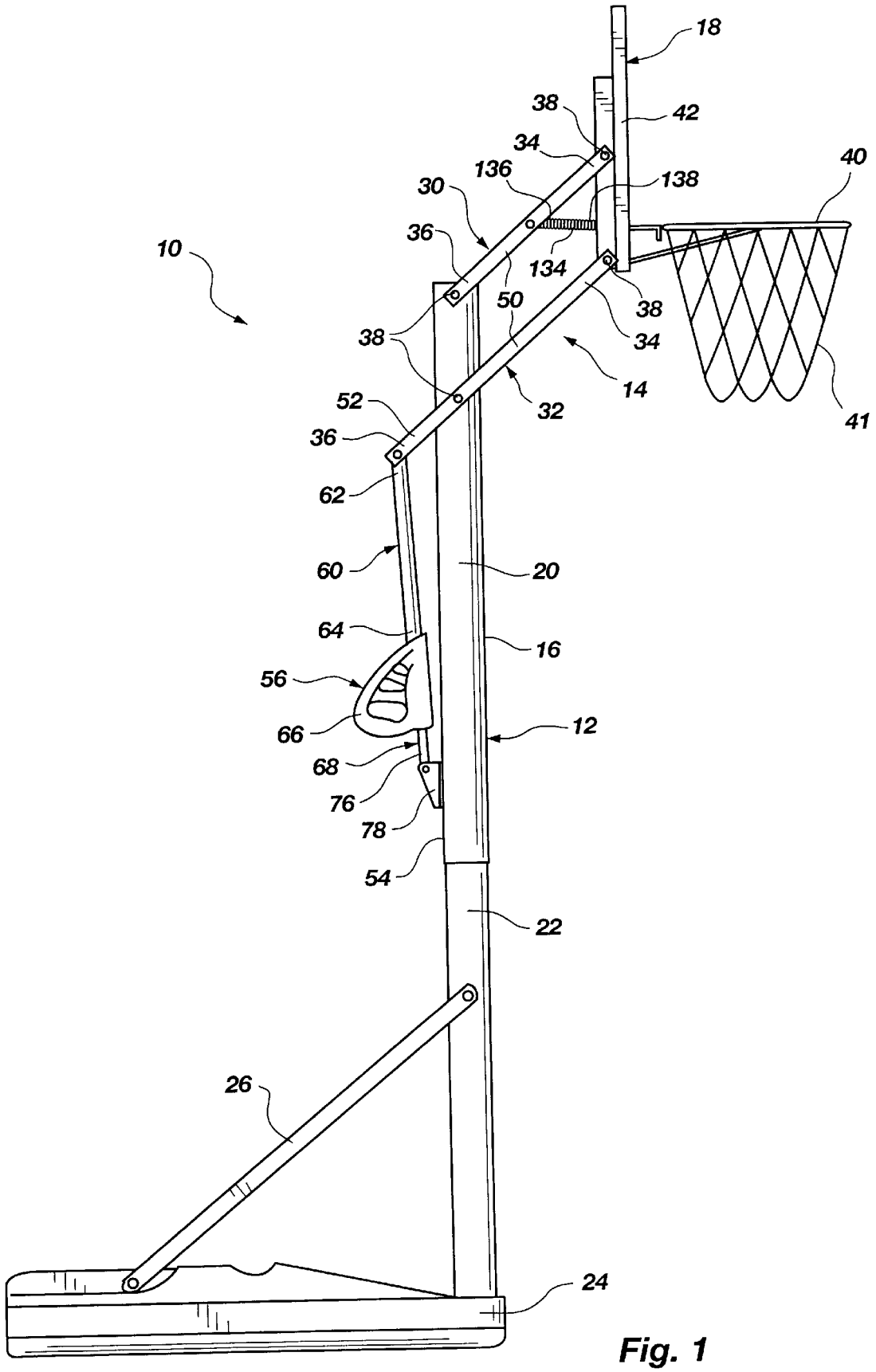
FIG. 1 is a side plan view of one presently preferred embodiment of the adjustable basketball goal system of the present invention.

With reference now to FIG. 1, one presently preferred embodiment of the quick-release locking mechanism for adjustable basketball goal system according to the present invention is generally designated at 10. As shown, the basketball goal system 10 includes a rigid support 12 extending in a substantially upward direction. A goal support structure 14 is disposed in relation to the rigid support 12 adjacent a goal side 16 of the rigid support 12 above a playing surface. A basketball goal 18 is attached to the goal support structure 14 opposite the rigid support 12. The goal support structure 14 may be deformable into a plurality of configurations wherein at each configuration the basketball goal 18 is disposed at a different height above the playing surface.

In one presently preferred embodiment, the rigid support 12 includes an upper pole section 20, to which the goal support structure 14 is attached, and a lower pole section 22 press fit into the upper pole section 20. This configuration makes the system easier and more cost effective to package. The lower pole section 22 may be attached to a ballast base 24, which when filled with ballast material, supports and stabilizes the adjustable basketball goal system 10. A pair of rods 26 secure the rigid support 12 to the ballast base 24. As will be appreciated by those of skill in the art, there are a variety of ways readily known in the art to stabilize or secure a rigid support in relation to a base.

The goal support structure 14 of the adjustable basketball goal system 10 comprises an upper support 30 and a lower support 32. The upper and lower supports, 30, 32 each have a first end 34 and a second end 36. In a presently preferred embodiment, the first end 34 of the upper and lower supports 30, 32, are pivotally attached to the basketball goal 18, which includes a backboard 42, a rim 40 and a net 41 attached to the rim. The upper and lower supports 30, 32 are each pivotally attached to the rigid support 12 adjacent the second ends 36 of the upper and lower supports 30, 32.

In one presently preferred embodiment, the upper and lower supports 30, 32 are pivotally attached to the basketball goal 18 and rigid support 12 by bolts 38 positioned through corresponding openings formed within the upper and lower supports 30, 32, the basketball goal 18 and the rigid support 12. As will be appreciated, there are a variety of other ways readily known in the art to pivotally attach a basketball goal to a rigid support 12 as are intended to be herein contemplated.

Structurally, the upper support 30, the lower support 32, the rigid support 12 and the backboard 42 define the goal support structure 14. As best shown in FIG. 1, the goal support structure 14 is preferably formed having a parallelogrammic configuration. Because the upper support 30 and the lower support 32 are pivotally mounted at each of its opposing ends 34, 36, the parallelogrammic goal support structure 14 can be deformed to adjust the height of the basketball goal 18 while allowing the backboard 42 to remain substantially vertical in disposition and the rim 40 to remain substantially horizontal in disposition.

In one presently preferred embodiment of the present invention, at least one of the supports 30, 32, includes a tail section 52 which extends a distance outwardly from the back side 54 of the rigid support 12 adjacent the second end 36 of the supports 30, 32. The tail section 52 may be formed integral with the lower support 32. Structurally, the tail section 52 provides a place to link the goal support structure 14 to an adjustment mechanism 56 which is preferably pivotally mounted adjacent the back side 54 of the rigid support 12 below the goal support structure 14.

Consistent with the foregoing structural configuration, the height of the basketball goal 18 may be adjusted without the aid of a separate adjustment device, ladder, stool, or the like. Further, with the adjustment mechanism 56 located on the back side 54 of the rigid support 12, the adjustment mechanism 56 is less likely to interfere with basketball play. In one presently preferred embodiment, the adjustment mechanism 56 comprises a handle 66 operably disposed in cooperation with a locking rod 68 and one or more locking plates 70 as discussed in detail herein below.

Still referring to FIG. 1, an extension arm 60 includes a first end 62 and a second end 64. The first end 62 of the extension arm 60 may be pivotally attached to the tail section 52 of the lower support 32. The second end 64 of the extension arm 60 may be disposed for cooperation with the locking rod 68. In one preferred embodiment, the locking rod 68 is pivotally attached at a first end 76 to the rigid support 12, by means of a bracket 78. The first end 76 may be flattened (see FIG. 2) to facilitate securement within the bracket 78.

Figure 2:
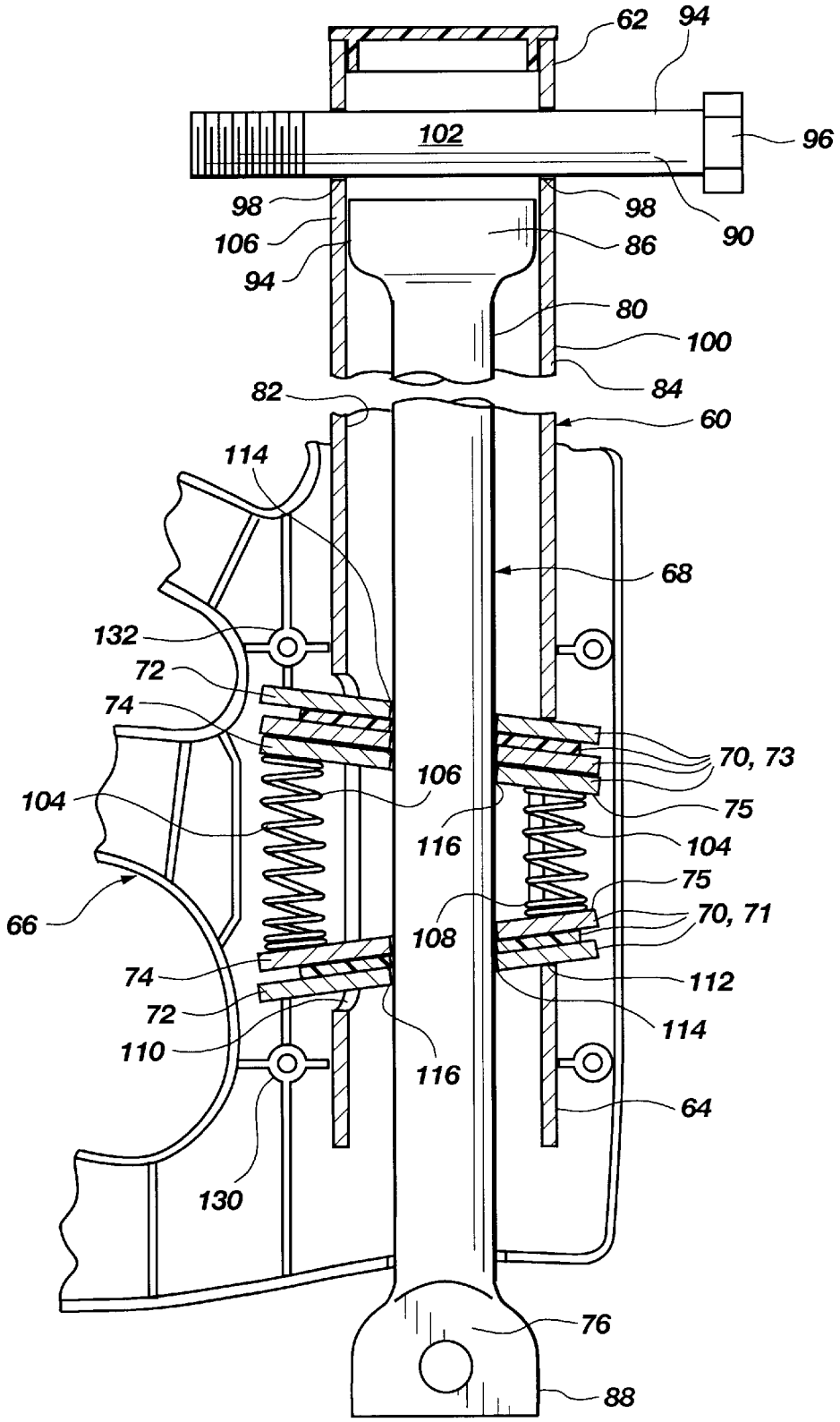
FIG. 2 is a partially cut away, side cross-sectional view of a quick-release locking mechanism of the adjustable basketball goal system of FIG. 1.

With reference now to FIGS. 1 and 2, a second end 80 of the locking rod 68 preferably engages a second end 64 of the extension arm 60 in telescopic engagement. Functionally, as the extension arm 60 telescopes in an upward direction relative to the locking rod 68, the goal support structure 14 will deform and the height of the basketball goal 18 will be lowered in relation to the playing surface. This is because the lower support 32 acts as a lever. As the weight of the basketball goal 18 pulls down at the lower support 32 on the goal side 16 of the rigid support 12, the lower support 32 pulls up on the extension arm 60 at the back side 54 of the rigid support 12. Accordingly, with the locking rod 68 attached to the rigid support 12 below the extension arm 60, the extension arm 60 and locking rod 68 are generally disposed in tension, which reduces the chance of buckling at the point of attachment.

In one presently preferred embodiment of the present invention, the extension arm 60 is substantially hollow having an inner surface 82 and an outer surface 84. The extension arm 60 is substantially cylindrical for ease of manufacturing. The locking rod includes an expanded portion 86 which flares out at the second end 80 which may be used to center the locking rod 68 within the extension arm 60. The expanded portion 86 facilitates the smooth interaction between the locking rod 68 and the extension arm 60.

As will be appreciated by those of skill in the art, the expanded portion 86, in conjunction with the extension arm 60 and locking rod 68, create a piston-type assembly that assists in safely controlling the speed of adjustment in relation to adjusting the height of the basketball goal 18.

The adjustable basketball goal system 10 of the present invention includes at least one, and preferably two, mechanical stops 94 to limit the telescopic movement of the extension arm 60 relative to the locking rod 68. A connecting bolt 96, which secures the extension arm 60 to the tail section 52 of the goal support structure 14, generally serves to limit movement of the extension arm 60 in the downward direction. The connecting bolt 96 is preferably positioned through openings 98 formed in opposite sides 100 of the extension arm 60 adjacent the first end 62 of the extension arm 60. A middle portion 102 of the bolt 96 is centered within the extension arm 60 and is thus, axially aligned with the locking rod 68. Accordingly, as the extension arm 60 is lowered relative to the locking rod 68, the second end 80 of the locking rod 68 will selectively engage the middle portion 102 of the connecting bolt 96 thereby restricting further movement of the extension arm 60 in the downward direction.

The expanded portion 86 at the second end 80 of the locking rod 68 serves to limit the movement of the extension arm 60 in the upward direction. As the extension arm 60 moves upward relative to the disposition of the locking rod 68, the locking plates 70 positioned within the extension arm 60 will generally engage this expanded portion 86 and prevent further movement of the extension arm 60 in the upward direction. As will be appreciated by those of skill in the art, the telescopic movement of the extension arm 60 relative to the locking rod 68 can be limited in a variety of other suitable ways known in the art. For example, the extension arm 60 and locking rod 68 can be configured in such a manner that the second end 80 of the locking rod 68 engages the inner surface 82 of the extension arm 60 as the extension arm 60 is maneuvered downward over the locking rod 68. Any number of pins or tabs attached or protruding from the inner surface 82 of the extension arm 60 or the locking rod 68 may also be used as a structural stop for limiting movement.

In one presently preferred embodiment, a first opening 110 is configured within one side 100 of the extension arm 60. A second opening 112 is configured within an opposing side 100 of the extension arm 60. The width of the openings 110, 112 in the preferred embodiment are substantially the same as the width of the locking plates 70 such that when the locking plates 70 are positioned within the openings 110, 112, the locking plates 70 are substantially prevented from lateral or rotational movement in relation to the extension arm 60. The length of the openings 110, 112 is configured to allow the locking plates 70 to be angled away from each other and into binding engagement with the locking rod 68.

The locking plates 70 are preferably formed as flat rectangular pieces having a substantially uniform thickness. In one presently preferred embodiment of the present invention, the locking plates 70 are each configured with an opening 114 through which the locking rod 68 is positioned. These openings 114 are larger than the diameter of the locking rod 68. This structural configuration allows the locking plates 70 to be positioned in a non-perpendicular angle relative to the locking rod 68 while the locking rod 68 is positioned within the openings 114. Accordingly, when the locking plates 70 are biased in a non-perpendicular angle relative to the locking rod 68, the locking plates 70 secured within the extension arm 60 will bind with the locking rod 68, thus preventing the locking rod 68 from moving relative to the extension arm 60.

As will further be appreciated, a variety of other locking plate 70 and locking rod 68 configurations are possible to accomplish this binding effect. For example, the locking plate or plates 70 could be elliptical or have a varying thickness. The locking plate openings 114 could also have varying configurations depending on the configuration of the locking rod 68.

Of importance is that the opening 114 in locking plates 70 be configured frictionally such that an edge of the locking plates opening 114 can engage the locking rod 68 to cause binding, and also allow for clearance of the locking rod 68 through the locking plates 70 when repositioned.

Figure 3:
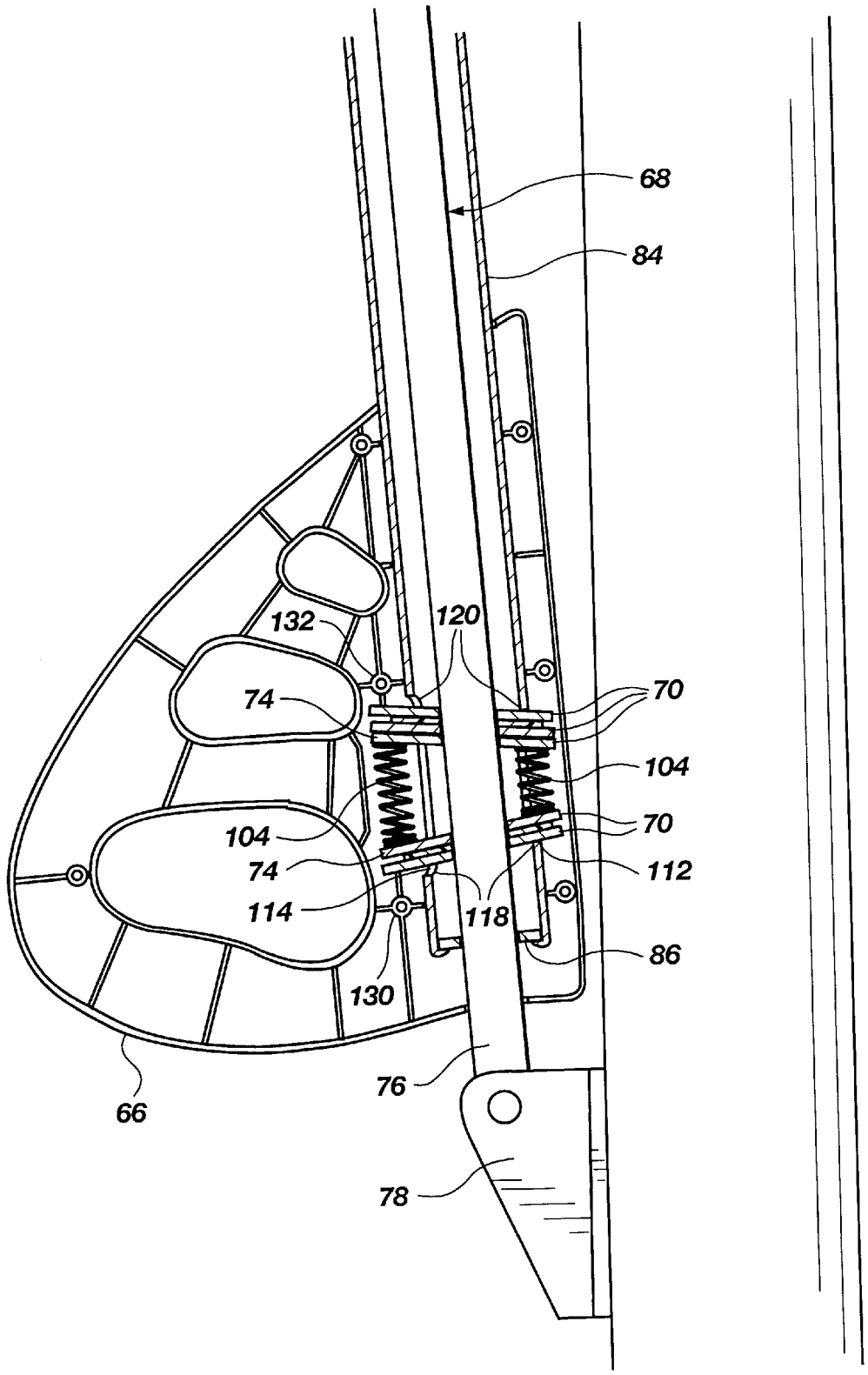
FIG. 3 is a side cross-sectional view of the adjustable basketball goal system of FIG. 1 with an adjustment handle in a rest position.

In one presently preferred embodiment of the present invention, a set of three lower locking plates 71 are generally positioned adjacent a bottom end 118 of each opening 110, 112 formed in the extension arm 60 and a set of four upper locking plates 73 are positioned adjacent a top end 120 of each opening 110, 112, as shown in FIG. 3. It will be appreciated by those of skill in the art that the locking plates 70 adjacent the bottom end of the openings 110, 112 restrict the movement of the extension arm 60 in the upward direction, the direction in the which the extension arm 60 is urged under the force of gravity acting on the basketball goal 18.

The locking plates 70 are preferably biased into a non-perpendicular or "binding" angle relative to the locking rod 68 by means of a biasing member 104. In one presently preferred embodiment, the biasing member 104 comprises a first biasing member 106 and second biasing member 108. The first and second biasing members 106, 108 comprises coil springs.

The first biasing member 106 may be positioned between respective first ends 72 of an innermost pair of locking plates 74. The first biasing member 106 angles the locking plates 70 away from each other and into a non-perpendicular angle or "binding position" relative to the locking rod 68. Correspondingly, the upper set of locking plates 73 will tend to bind with the locking rod 68 as the extension arm 60 is moved in the a substantially downward direction and the lower set of locking plates 71 will tend to bind with the locking rod 68 as the extension arm 60 is moved in a substantially upward direction. In other words, the upper set of locking plates 73 may be angled to prevent compression of the extension arm 60 relative to the locking rod 68 (i.e., "compression plates") and the upper set of locking plates 73 may be angled to prevent tension between the extension arm 60 and the locking rod 68 (i.e., "tension plates").

Preferably, the second biasing member 108 is positioned between respective second ends 75 of an innermost pair of locking plates 74. The second biasing member 108 generally provides a force against which the plates 70 may pivot and helps maintain the innermost pair of locking plates 74 in a separated state, thus facilitating the pivotal movement of the locking plates 70.

It will be appreciated by those of skill in the art that a variety of biasing members 104 may used in a variety of configurations to urge the locking plates 70 into non-perpendicular angles relative to the locking rod 68 thereby permitting the locking rod 68 to bind with the locking plates 70. One such alternative embodiment includes pliable metal disposed between the locking plates 70. In this configuration, the locking plates 70 and the pliable metal could be one unitary piece. In another configuration, tension springs may be used.

Figure 4:
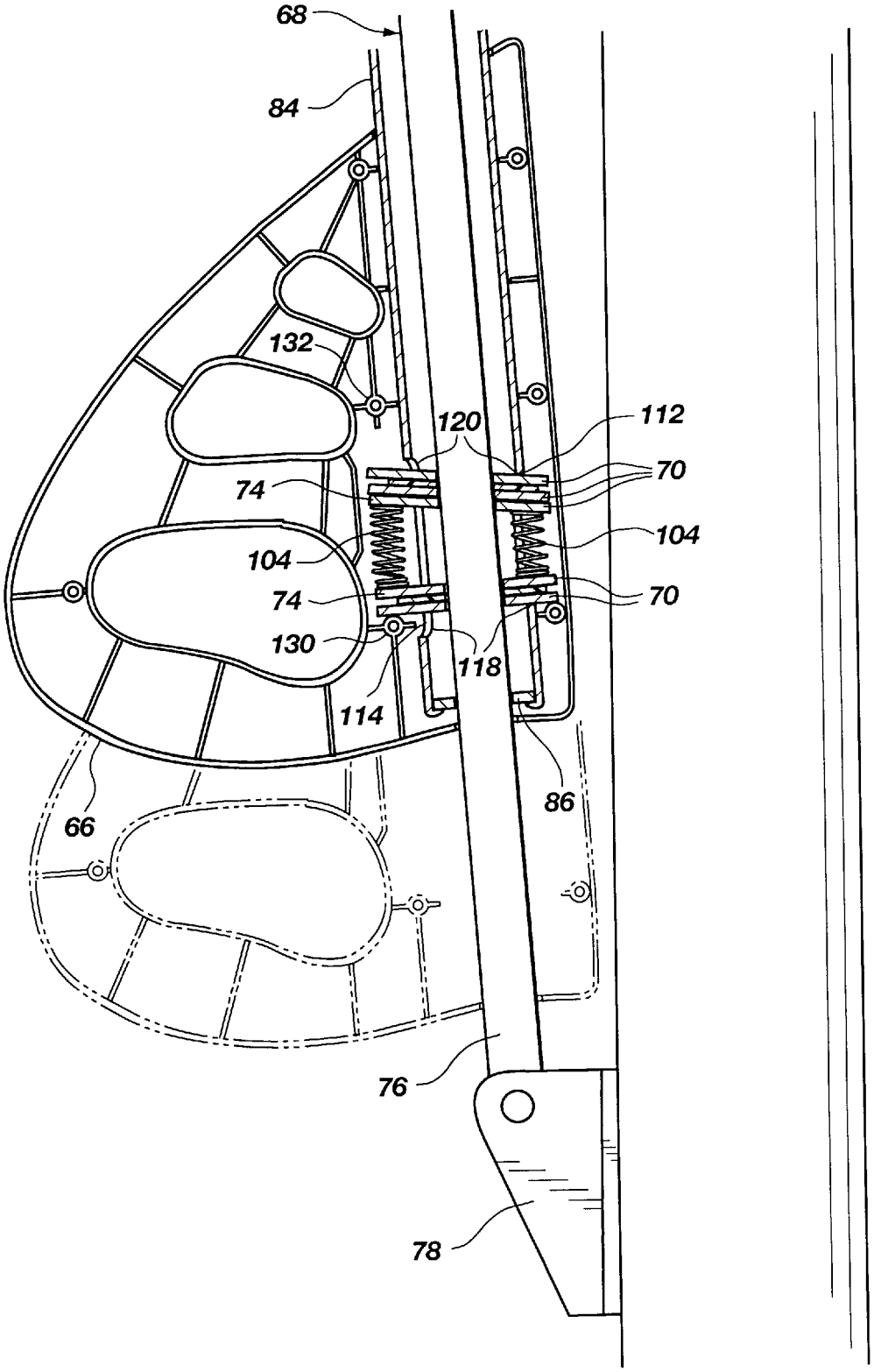
FIG. 4 is a side cross-sectional view of the adjustable basketball goal system of FIG. 1 with the adjustment handle in an engaged position.

With reference now to FIGS. 2, 3 and 4, the adjustment handle 66 is movably mounted to the outer surface 84 of the extension arm 60. The interior of the adjustment handle 66 is configured for engagement with the locking plates 70. In one presently preferred embodiment of the present invention, the adjustment handle 66 has a lower abutment portion 130 and an upper abutment portion 132. The adjustment handle 66 is selectively movable between a rest position, an upward engaged position, and a downward engaged position. In the rest position, a first end 72 of each set of locking plates 70 are angled away from each other, securing the locking rod 68 relative to the extension arm 60. When the adjustment handle 66 is moved into the upward engaged position, the lower abutment portion 130 of the adjustment handle 66 forces the tension locking plates 73 into a substantially perpendicular angle relative to the locking rod 68. This allows the adjustment handle 66 and extension arm 60 to move relatively upwardly in relation to the locking rod 68. In the downward engaged position, the upper abutment portion 132 of the handle 66 forces the compression locking plates 71 into a substantially perpendicular angle relative to the locking rod 68. This allows the adjustment handle 66 and extension arm 60 to move relatively downward in relation to the locking rod 68, thereby compressing the locking rod 68 and extension arm 60 in relation therebetween.

Consistent with the novel design and structural configuration of the quick-release locking mechanism of the present invention, the basketball goal system 10 can be adjusted by using the single hand of a user. By sliding the adjustment handle 66 substantially upward along the outer surface 84 of the extension arm 60, the adjustment handle 66 releases the tension locking plates 70 acting against the locking rod 68. At this instance, the extension arm 60 is free to move upward relative to the locking rod 68, and continual upward motion adjusts the basketball goal 10 to a lower height above the playing surface. Likewise, by sliding the handle 60 downward along the outer surface 84 of the extension arm 60, the handle 66 releases the releases compression locking plates. At this instance, the extension arm 60 is free to move downward relative to the locking rod 68, and continual downward motion adjusts the basketball goal 18 to a greater height above the playing surface.

As will be appreciated by those of skill in the art, the adjustment handle 66 can be configured in a variety of ways sufficient to accommodate the release of the binding effect of the locking plates 70 on the locking rod 68. For example, one such embodiment is to secure a cross-member to the locking plates 70. The cross-member could extend outwardly through the openings formed in the adjustment handle 66 such that as the handle 66 is engaged, the openings in the handle 66 would engage the cross-member which would in turn move the locking plate 70 into a substantially perpendicular position relative to the locking rod 68. This would obviate the need for abutment portions 130, 132.

As best shown in FIG. 1, the adjustable basketball goal system 10 of the present invention is preferably counterbalanced with counterbalance member 134. In one presently preferred embodiment, the counterbalance member 134 is disposed in relation to the goal support structure 14 to provide a force which substantially counterbalances the gravitational force acting on the adjustable basketball goal system 10 due to the inherent weight of the basketball goal 18. The counterbalance member 134 preferably comprises a coil spring of sufficient rigidity and stiffness to resist the weight of the basketball goal 18. The spring 134 may be attached at one end 136 to the upper support 30 of the goal support structure 14 and at a second end 138 to the a frame 140 to which the backboard 42 is secured. In operation, the counterbalance member 134 allows for adjustment of the height of the basketball goal 18 above the playing surface with minimal effort on the part of the user.

As will be appreciated, there are several ways to counterbalance an adjustable basketball goal system 10. One such way is to place a spring within the extension arm 60. One end of the extension spring could be attached to a connecting bolt pivotally connected to the tail section 52 of one of the supports 30, 32 of the goal support structure 14. The other end could be attached to the rigid support 12 through a slot formed in the extension arm 60. A piston assembly could also be used to counterbalance the adjustable basketball goal system 10.

With reference now to FIGS. 3 and 4, the basketball goal 18 may be adjusted by releasably engaging the adjustment handle 66. In accordance with one such method, the user moves the adjustment handle 66 with a first hand to facilitate one of the abutment portions 130, 132 to engage and reposition the locking plates 70 into a non-binding position relative to the locking rod 68. By continuing to move the adjustment handle 66, with the same hand in the same direction, the extension arm 60 moves and deforms the goal support structure 14 to one of an infinite plurality of deformations. The user then disengages the adjustment handle 66 to dispose the basketball goal 18 in the desired position above the playing surface.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An adjustable basketball goal system allowing for adjustment of the height of a basketball goal above a playing surface, comprising:

a rigid support;

a goal support structure disposed in relation to said rigid support, said goal support structure being deformable into a plurality of configurations wherein at each configuration said basketball goal is disposed at a different height above said playing surface;

an extension arm having a first end connected to said goal support structure;

a locking rod having a first end attached to said rigid support and a second end disposed in telescopic engagement with said extension arm; and at least one locking plate disposed in relation to said extension arm and being selectively movable between an engaged position and a disengaged position relative to said locking rod.

2. The adjustable basketball goal system of claim 1, wherein said deformable goal structure comprises a substantially parallelogrammic configuration.

3. The adjustable basketball goal system of claim 1, wherein said locking plate is disposed within an opening formed in said extension arm.

4. The adjustable basketball goal system of claim 1, wherein said locking plate is positioned relative to said locking rod such that at a predetermined angle relative to the locking rod, the locking plate prevents the locking rod from moving relative to said extension arm.

5. The adjustable basketball goal system of claim 1, further comprising a biasing member positioned to bias said locking plate into a non-perpendicular angle relative to said locking rod thereby permitting the locking rod to bind with the locking plate and prevent movement of the locking rod relative to said extension arm.

6. The adjustable basketball goal system of claim 1, further comprising an adjustment handle mounted in relation to said extension arm and being disposed in operable engagement with said locking plate.

7. The adjustable basketball goal system of claim 6, wherein said adjustment handle is configured to engage and urge said locking plate into a substantially perpendicular position relative to said locking rod when the adjustment handle is disposed in said engaged position, thereby permitting said extension arm to move relative to the locking rod.

8. The adjustable basketball goal system of claim 1, further comprising a counterbalance member attached within the goal support structure to provide a resistant force which substantially counterbalances the gravitational force acting on the adjustable basketball goal system due to the weight of the basketball goal.

9. The adjustable basketball goal system of claim 1, wherein at least two locking plates are engageably disposed in relation to said locking rod.

10. An adjustable basketball goal system allowing for adjustment of the height of a basketball goal above a playing surface, comprising:

a rigid support;

a goal support structure disposed in relation to said rigid support, said goal support structure being deformable into a plurality of configurations wherein at each configuration said basketball goal is disposed at a different height above said playing surface;

an extension arm having a first end pivotally connected to said goal support structure and a second opposing end;

a locking rod having a first end attached to said rigid support and a second opposing end operably disposed in telescopic engagement with said second end of said extension arm such that movement of the extension arm relative to said locking rod deforms said goal support structure;

at least one locking plate disposed in relation to said extension arm, said locking plate being selectively movable between an engaged position and a disengaged position relative to said locking rod; and an adjustment handle movably mounted to said extension arm and disposed in operable engagement with said locking plate.

11. The adjustment basketball goal system of claim 10, further comprising a biasing member positioned to bias said locking plate into a non-perpendicular angle relative to said locking rod thereby permitting the locking rod to bind with the locking plate to substantially prevent said extension arm from moving relative to the locking rod.

12. The adjustable basketball goal system of claim 10, further comprising at least one spacer positioned between said locking rod and an inside surface of said extension arm.

13. The adjustable basketball goal system of claim 10, wherein said extension arm is configured with an opening in a first side and an opening in an opposing side, said openings configured to allow at least one locking plate to selectively move through a predetermine range of motion within the extension arm.

14. The adjustable basketball goal system of claim 13, wherein at least two locking plates are disposed in relation to said extension arm and said locking rod.

15. The adjustable basketball goal system of claim 14, wherein one of said openings is larger than said other opening to permit said locking plates to be positioned within the openings with the locking plates being angled away from each other.

16. The adjustable basketball goal system of claim 14, wherein said adjustment handle is configured to movably engage an outer surface of said extension arm between a rest position, wherein at least one locking plate binds with said locking rod to substantially prevent the locking rod from moving relative to the extension arm, and an engaged position, wherein a portion of the adjustment handle forces at least one locking plate into a substantially perpendicular position relative to the locking rod, thereby permitting the extension arm to move relative to the locking rod.

17. The adjustable basketball goal system of claim 10, wherein said adjustment handle comprises at least one abutment portion configured to engage a locking plate when the adjustment handle is disposed in said engaged position.

18. The adjustable basketball goal system of claim 10, wherein said adjustment handle comprises at least one abutment portion configured to engage and urge said locking plate into a substantially perpendicular position relative to said locking rod when said adjustment handle is disposed in said engaged position, thereby permitting said extension arm to move relative to the locking rod.

19. The adjustable basketball goal system of claim 10, further comprising at least one structural stop formed in relation to said extension arm to prevent movement of said locking rod relative to the extension arm at a predetermined position.

20. A method for adjusting the height of a basketball goal system, said basketball goal system comprising a deformable goal support structure secured to a rigid support above a playing surface, an extension arm pivotally attached to said goal support structure, a locking rod having a first end attached to said rigid support and a second opposing end disposed in telescopic engagement with said extension arm, and at least one locking plate operably disposed in relation to said locking rod, said locking plate adapted to be selectively movable between an engaged position wherein the locking plate restricts deformation of the goal support structure and a disengaged position wherein the goal support structure may be freely deformed, said adjustment method comprising the steps of:

disposing said locking plate in said disengaged position;

deforming said goal support structure while maintaining said locking plate in said disengaged position; and disposing said locking plate in said locked position.

21. The method of claim 20, wherein said steps of disposing said locking plate in said disengaged position, deforming said goal support structure, and disposing said locking plate in said engaged position can be performed using one hand of a user.

22. The method of claim 20, wherein said locking plate is positioned at a predetermined angle relative to said locking rod to bind the locking rod from movement relative to said extension arm and wherein said step of disposing the locking plate in the disengaged position comprises repositioning the locking plate relative to the locking rod such that the locking rod is permitted to move relative to the locking plate.

23. The method of claim 20, wherein said basketball goal further comprises an adjustment handle mounted in relation to said extension arm and being disposed in operable engagement with said locking plate, wherein the step of disposing the locking plate in said disengaged position further comprises engaging said adjustment handle to move the locking plate such that said goal support structure may be freely deformed and wherein said step of disposing the locking plate in said engaged position further comprises disengaging the adjustment handle thereby disposing the locking plate in a position to bind said locking rod.

24. The method of claim 23, further comprising the steps of engaging said adjustment handle, manipulating the adjustment handle with a first hand of a user to position the locking plate into said disengaged position, moving the adjustment handle to deform said goal support structure to one of an infinite plurality of deformations with said first hand, and disengaging the adjustment handle.

25. The method of claim 20, wherein said goal support structure may be positioned at one of an infinite plurality of configurations, and wherein said step of deforming the goal support structure includes deforming the goal support structure to a predetermined configuration.

26. The method of claim 20, further comprising a biasing member positioned to bias said locking plate into a non-perpendicular angle relative to said locking rod thereby permitting the locking rod to bind with the locking plate to substantially prevent said extension arm from moving relative to the locking rod.

27. The method of claim 20, further comprising a counterbalance member attached within the goal support structure to provide a resistant force which substantially counterbalances the gravitational force acting on the adjustable basketball goal system due to the weight of the basketball goal.

* * * * *